US006095257A

United States Patent [19]

Lee

[11] Patent Number: 6,095,257

[45] Date of Patent: Aug. 1, 2000

[54] HYDRAULIC HAMMER HAVING BUFFER ASSEMBLY

[75] Inventor: Gun-jik Lee, Incheon, Rep. of Korea

[73] Assignee: HyupSung Heavy Industries Co., Ltd., Incheon-city, Rep. of Korea

[21] Appl. No.: 09/095,400

[22] Filed: Jun. 10, 1998

[30] Foreign Application Priority Data

Jun. 11, 1997 [KR] Rep. of Korea ..... 97-24201

[51] Int. Cl.[7] ..... B25D 17/24

[52] U.S. Cl. ..... 173/211; 173/162.1

[58] Field of Search ..... 173/162.2, 162.1, 173/211, 210, 219, DIG. 2, 15; 267/137, 141.1, 140.4

[56] References Cited

U.S. PATENT DOCUMENTS

| | | | |
|---|---|---|---|
| 2,058,583 | 10/1936 | Forss | 173/162.2 |
| 3,866,690 | 2/1975 | Lance et al. | 173/15 |
| 3,968,843 | 7/1976 | Shotwell | 173/162.2 |
| 4,332,300 | 6/1982 | Scarton et al. | 172/212 |
| 4,921,053 | 5/1990 | Dobry et al. | 173/162.2 |
| 5,285,858 | 2/1994 | Okada et al. | 172/162.1 |
| 5,322,131 | 6/1994 | Pressley et al. | 173/162.1 |
| 5,363,835 | 11/1994 | Robson | 173/162.1 |
| 5,370,193 | 12/1994 | Sippus et al. | 173/162.1 |
| 5,407,018 | 4/1995 | Henry | 173/162.1 |
| 5,598,893 | 2/1997 | Carlson | 173/216 |

FOREIGN PATENT DOCUMENTS 97-2112 1/1997 Rep. of Korea .

*Primary Examiner*—Peter Vo
*Assistant Examiner*—James Calve
*Attorney, Agent, or Firm*—Dvorak & Orum

[57] ABSTRACT

A hydraulic hammer having an improved buffer assembly is provided. The hydraulic hammer includes a housing, a top cover plate connected to the upper portion of the housing, a hammer assembly installed in the housing, and a buffer assembly for supporting the hammer assembly, installed between the top cover plate and the hammer assembly, in which the buffer assembly includes a top buffer contacting the upper portion of the hammer assembly and formed of an elastic material for absorbing impact, and a sliding plate is disposed between the top buffer and the top cover plate. The hydraulic hammer reduces the repeated banding stress applied to the hammer assembly.

10 Claims, 4 Drawing Sheets

HYDRAULIC HAMMER HAVING BUFFER ASSEMBLY

BACKGROUND OF THE INVENTION

1. Field of the Invention

The present invention relates to a hydraulic hammer having buffer assembly, and more particularly, to a hydraulic hammer for reducing stress having an improved structure in which repeated tensile banding stress applied to the hammer assembly can be reduced.

2. Description of the Related Art

In general, a hydraulic hammer includes a housing assembly and a hammer assembly, in which a piston installed in a hammer assembly rises and falls by controlling the high pressure fluid of a hydraulic pump supplied to a hammer assembly to forcibly move a tool, which crushes boulders or concrete by forceful impact of the tool. The hammer assembly is installed in the housing assembly, which is mounted on apparatuses such as an excavator or a loader.

Referring to FIG. 1, a housing assembly includes a housing 210, a top cover plate 220, a top buffer 250, an upper wearing plate 240 and a lower wearing plate 230, and a hammer assembly includes an accumulator 110, a valve housing 120, a cylinder 130, a front head 140 and a side rod 131.

The upper wearing plate 240 and the lower wearing plate 230 support the front head 140 of the hammer assembly to suppress horizontal movement, and the top buffer 250 supports the hammer assembly to suppress movement against the tool and absorb impacts of the hammer assembly.

The upper wearing plate 240 and the lower wearing plate 230 formed of urethane or plastic may be deformed. Thus, when external force is applied, the hammer assembly in the housing assembly rotates around the front head 140. Here, when the upper portion of the hammer assembly does not rotate, fatigue due to tensile banding stress accumulates on the side rod 131 of the hammer assembly.

The conventional top plate 220 is typically formed of a steel plate and the top buffer 250 is formed of urethane, so that the top plate 220 and the top buffer 250 do not easily slide. Thus, repeated tensile banding stress is applied to the hammer assembly during operation, which causes failure of the side rod 131.

SUMMARY OF THE INVENTION

To solve the above problems, it is an objective of the present invention to provide a hydraulic hammer having an improved buffer assembly for reducing the repeated tensile stress applied to a hammer assembly.

Accordingly, to achieve the above objective, there is provided a hydraulic hammer having an improved buffer assembly includes a housing, a top cover plate connected to the upper portion of the housing, a hammer assembly installed in the housing, and a buffer assembly for supporting the hammer assembly, installed between the top cover plate and the hammer assembly, in which the buffer assembly comprises a top buffer contacting the upper portion of the hammer assembly and formed of an elastic material for absorbing impact, and a sliding plate is disposed between the top buffer and the top cover plate.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
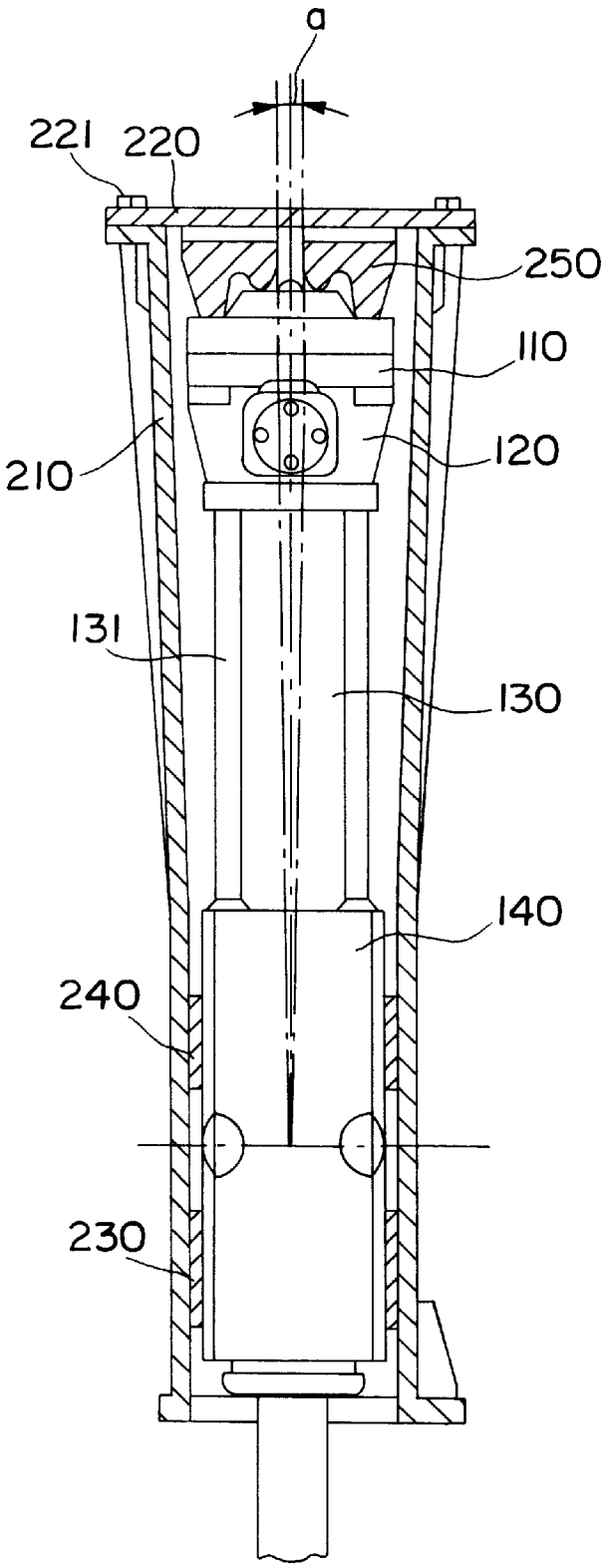
FIG. 1 PRIOR ART
FIG. 1 is a sectional view of a conventional hydraulic hammer.
Figure 2:
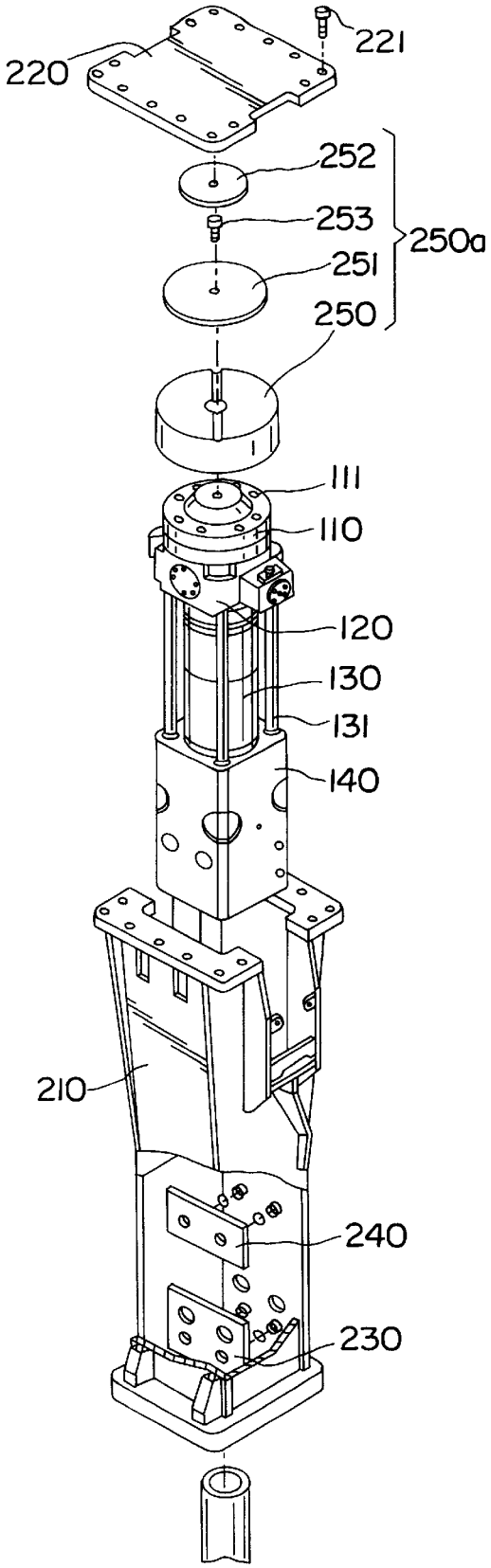
FIG. 2 is an exploded perspective view of a hydraulic hammer having an improved buffer assembly according to the present invention.

Referring to FIG. 2, a housing assembly includes a housing 210, a top cover plate 220 connected to the upper portion of the housing, a buffer assembly 250*a*, an upper wearing plate 240 and a lower wearing plate 230. The hammer assembly includes an accumulator 110, a valve housing 120, a cylinder 130, a front head 140 and a side rod 131.

The valve housing 120, the cylinder 130 and the front head 140 are sequentially stacked, which are pressed and fixed by four side rods 131. Also, the accumulator 110 is fixed and supported to the valve housing 120 by bolts 111.

To construct the hammer assembly in the housing assembly, the hammer assembly together with the upper wearing plate 240 and the lower wearing plate 230 is assembled in the housing 210. The buffer assembly 250*a* is located between the accumulator 110 and the top cover plate 220.

The upper wearing plate 240 and the lower wearing plate 230 support the front head 140 of the head assembly to suppress horizontal movement of the front head 140. Also, the buffer assembly 250*a* supports the hammer assembly to suppress vertical movement of the hammer assembly and thus absorb impacts of the hammer assembly.

Figure 3:
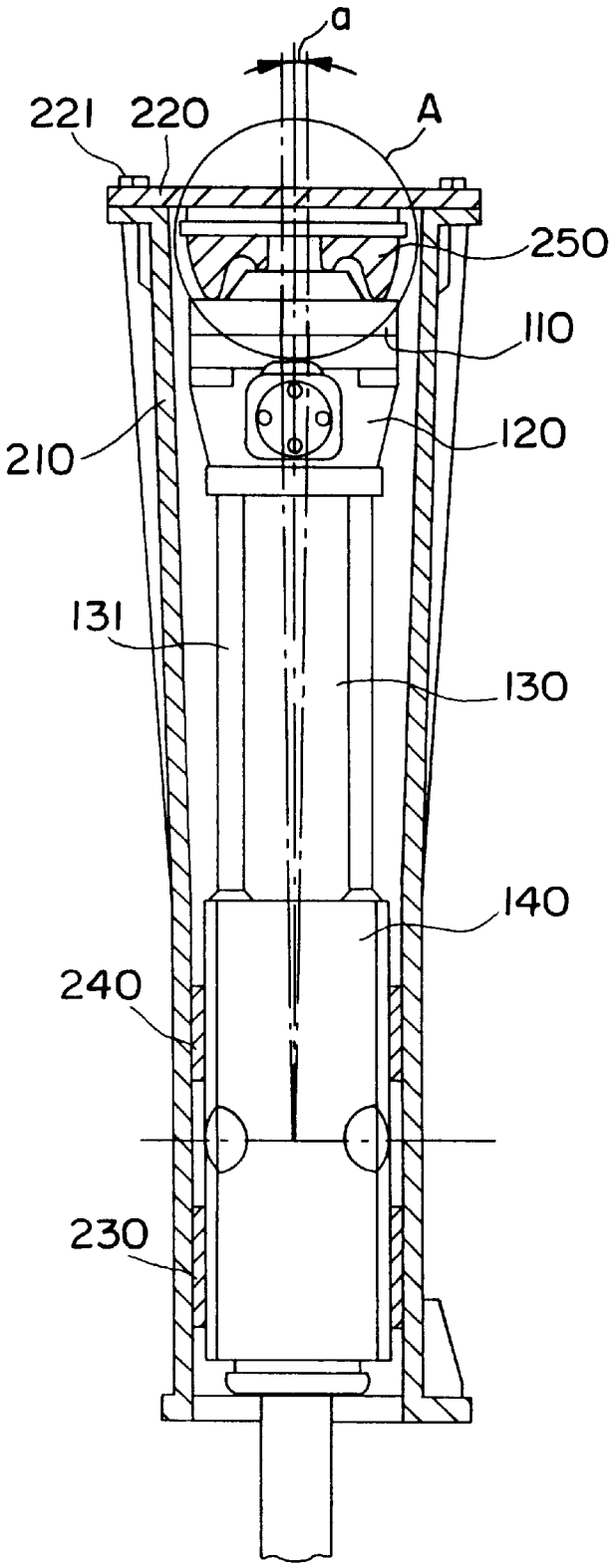
FIG. 3 is a sectional view of the hydraulic hammer having an improved buffer assembly according to the present invention.

Referring to FIG. 3, the upper wearing plate 240 and the lower wearing plate 230 formed of urethane or plastic may be elastically deformed. Thus, when an external force is applied, the hammer assembly in the housing assembly is vibrated within a predetermined angle a around the front head 140. Here, the buffer assembly 250*a* vibrates the upper portion of the hammer assembly within a predetermined angle a around the front head 140, and absorbs impact from the hammer assembly.

Figure 4:
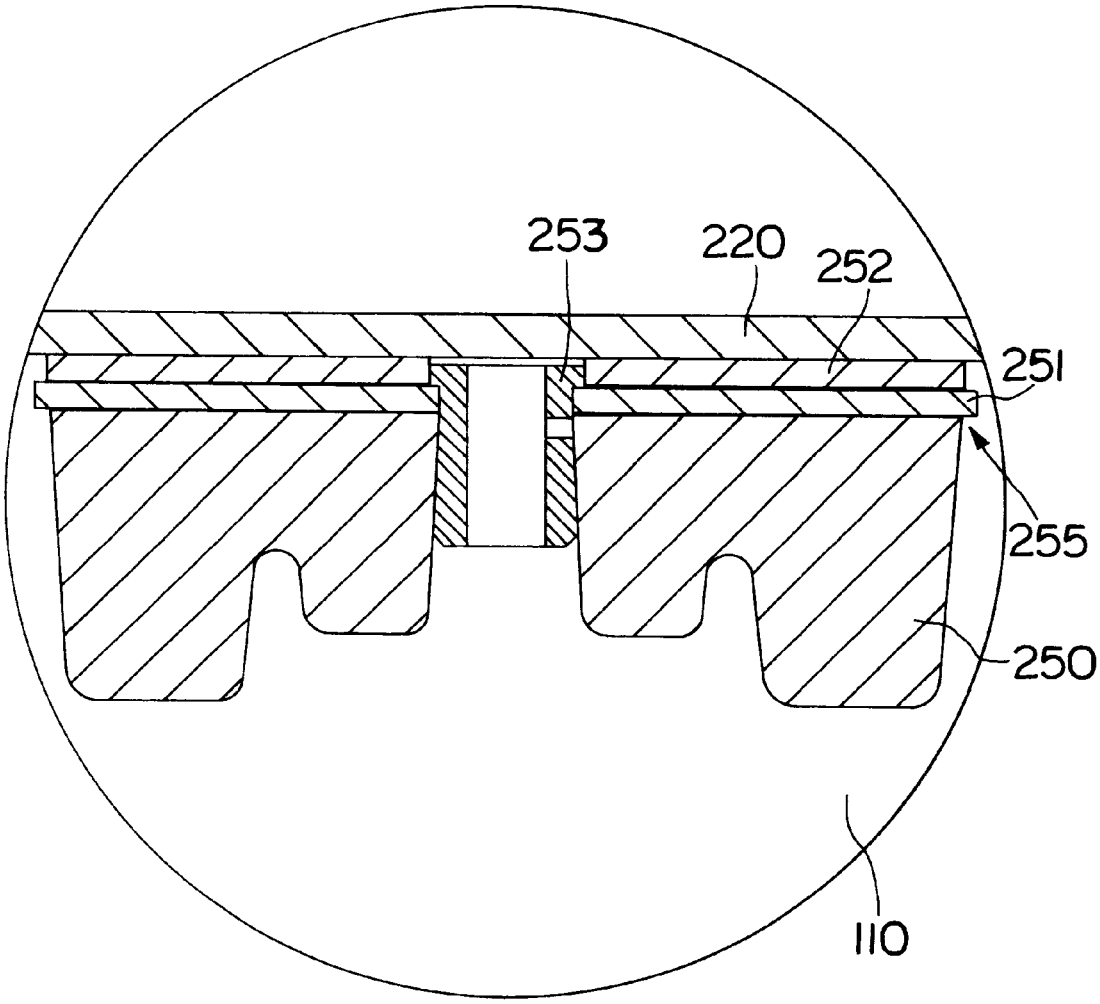
FIG. 4 is an enlarged sectional view of portion A of FIG. 3.

Referring to FIG. 4, the buffer assembly 250*a* includes a top buffer 250 formed of urethane which is elastically transformed to absorb impact, a top buffer plate 251 formed of a rigid steel plate, installed on the top buffer 250, and a sliding plate 252 formed of plastic between the top buffer plate 251 and the top cover plate 220.

There is no sliding between the urethane and the steel plate, however, sliding occurs between the steel plate and the plastic. Particularly, if the plastic is lubricated, the sliding between the steel plate and the plastic is smooth. Thus, when the hammer assembly is vibrated within a predetermined angle a around the front head 140 by the external force, the upper portion of the hammer assembly slides due to the sliding plate 252 to be appropriately vibrated, to thereby reduce the tensile stress applied to the hammer assembly.

Preferably, each center of the top buffer 250, the sliding plate 252 and the top buffer plate 251 has a hole, and a connection member 253 is fixed to the hole of the top buffer plate 251. It is also preferable that the connection member 253 partially inserts into the holes of the top buffer 250 and the sliding plate 252. This is for preventing the sliding plate 252 and the top buffer plate 251 from being eccentric from the center of the hammer assembly.

Preferably, the maximum radius of the top buffer plate 251 is greater than that of the top buffer 250, because when the maximum radius of the top buffer plate 251 is equal to or less than that of the top buffer 250, the elastical top buffer 250 is damaged by an edge 255 of the top buffer plate 251. It is also preferable that the maximum radius of the top buffer plate 251 is equal to or greater than that of the sliding plate 252, because the top buffer plate 251 supports the sliding plate 252.

Meanwhile, the buffer assembly without the top buffer plate 251 may have the same effect as that of the present invention.

According to the hydraulic hammer having an improved buffer assembly of the present invention, the upper portion of the hammer assembly is vibrated within a predetermined angle a around the front head, to thereby reduce the repeated tensile stress applied to the hammer assembly.

It should be understood that the invention is not limited to the illustrated embodiment and that many changes and modifications can be made within the scope of the invention by a person skilled in the art.

What is claimed is:

1. A hydraulic hammer comprising:

a housing, having an upper portion;

a top cover plate having a lower portion and connected to the upper portion of the housing;

a hammer assembly having, an upper portion installed in the housing; and a buffer assembly for supporting the hammer assembly, installed between the top cover plate and the hammer assembly, wherein the buffer assembly comprises a top buffer, a sliding plate and a top buffer plate, and a connection member disposed in a central portion of each said top buffer, sliding plate, and top buffer plate, said top buffer contacts the upper portion of the hammer assembly and is manufactured from an elastic material for absorbing impact, said sliding plate has a top and a bottom surface, contacts the lower portion of the top cover plate and is manufactured from a non-elastic lubricated plastic material, said top surface of said sliding plate slides along said lower portion of the top cover plate, and said top buffer plate is disposed between the top buffer and the sliding plate, wherein said top buffer plate slides along the bottom surface of sliding plate.

2. The hydraulic hammer of claim 1, wherein the top buffer is formed of urethane.

3. The hydraulic hammer of claim 1, wherein the top buffer plate is formed of a steel plate.

4. The hydraulic hammer of claim 1, wherein said top buffer plate and said top buffer each have a radius, said radius of the top buffer plate is greater than said radius of the top buffer.

5. The hydraulic hammer of claim 1, wherein said top buffer plate and said sliding plate each have a radius, said radius of the top buffer plate is greater than or equal to said radius of the sliding plate.

6. A hydraulic hammer comprising:

a housing, having an upper portion;

a top cover plate having at lower portion and connected to the upper portion of the housing;

a hammer assembly having an upper portion installed in the housing; and a buffer assembly for supporting the hammer assembly, installed between the top cover plate and the hammer assembly, wherein the buffer assembly comprises a top buffer, a top buffer plate and a sliding plate, said top buffer contacts the upper portion of the hammer assembly and is manufactured from an elastic material for absorbing impact, said top buffer plate is disposed between the top buffer and the sliding plate, said sliding plate has a top and a bottom surface and is manufactured from a non-elastic plastic material, said top buffer, said top buffer plate and said sliding plate each include a central hole wherein said central holes are generally aligned, a connection member is fixed to the central hole of the top buffer plate and inserted partially through the central holes of the top buffer and the sliding plate, wherein said connection member maintains the sliding plate disposed between the top buffer plate and the top cover plate, while simultaneously allowing the bottom surface of the sliding plate to slide along the top buffer plate and the top surface of the sliding plate to slide along the bottom surface of the top cover plate, whereby the dual sliding action of the sliding plate facilitate the reduction of repeated lateral stresses that are applied to the hammer assembly while in use.

7. The hydraulic hammer of claim 6, wherein the top buffer is formed of urethane.

8. The hydraulic hammer of claim 6, wherein the top buffer plate is formed of a steel plate.

9. The hydraulic hammer of claim 6 wherein said top buffer plate and said top buffer each have a radius, said radius of the top buffer plate is greater than said radius of the top buffer.

10. The hydraulic hammer of claim 6 wherein said top buffer plate and said sliding plate each have a radius, said radius of the top buffer plate is greater than or equal to said radius of the sliding plate.

* * * * *